US006122459A

United States Patent [19]

Ogasawara

[11] Patent Number: 6,122,459

[45] Date of Patent: Sep. 19, 2000

[54] DEVELOPER AMOUNT DETECTING APPARATUS

[75] Inventor: Yoshimi Ogasawara, Shizuoka-ken, Japan

[73] Assignee: Canon Kabushiki Kaisha, Tokyo, Japan

[21] Appl. No.: 09/240,840

[22] Filed: Feb. 1, 1999

[30] Foreign Application Priority Data

Feb. 3, 1998 [JP] Japan ..... 10-022385

[51] Int. Cl.[7] ..... G03G 15/08

[52] U.S. Cl. ..... 399/27; 118/694; 399/64

[58] Field of Search ..... 399/27, 13, 61, 399/64, 119; 118/691, 694; 222/DIG. 1

[56] References Cited

U.S. PATENT DOCUMENTS 5,398,106 3/1995 Eguchi ..... 399/110
5,587,770 12/1996 Jo et al. ..... 399/27
5,621,221 4/1997 Shinohara et al. ..... 399/61 X

*Primary Examiner*—William Royer
*Assistant Examiner*—Hoan Tran
*Attorney, Agent, or Firm*—Fitzpatrick, Cella, Harper & Scinto

[57] ABSTRACT

A developer amount detecting apparatus includes a light emitting device, a light receiving device, threshold value setting device for setting a threshold value on the basis of an intensity of the light received by the light receiving device, and a detector for detecting an amount of a developer within the developer container on the basis of the threshold value and the intensity of the light received by the light receiving device.

13 Claims, 12 Drawing Sheets

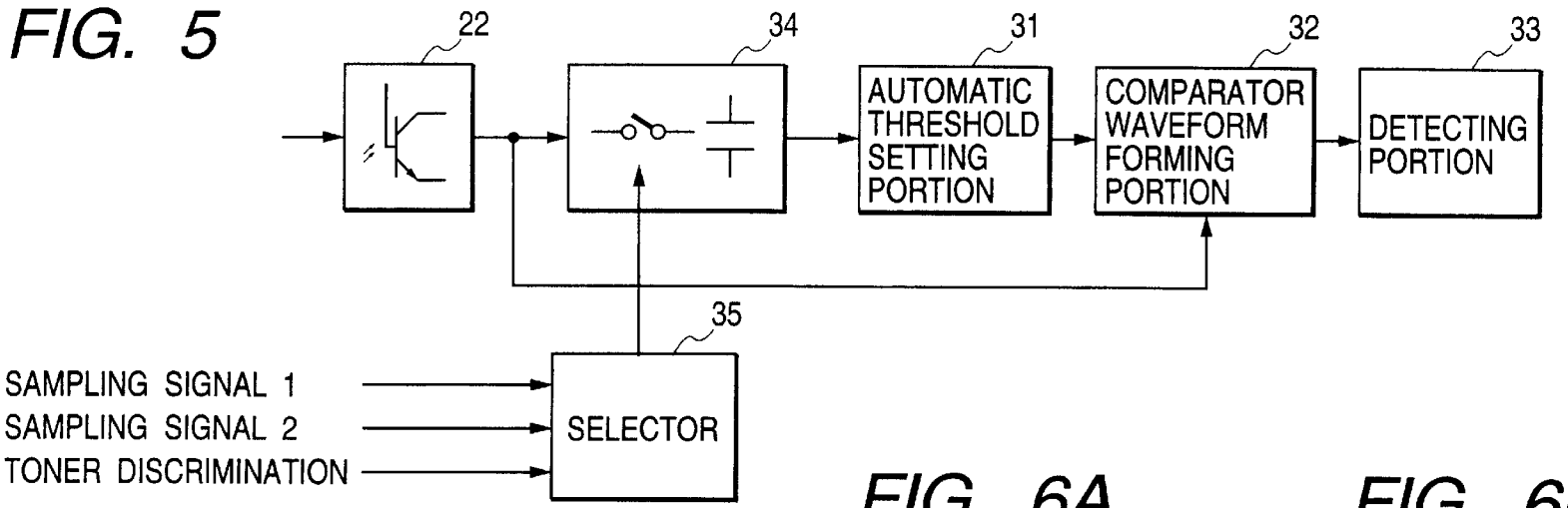
FIG. 5
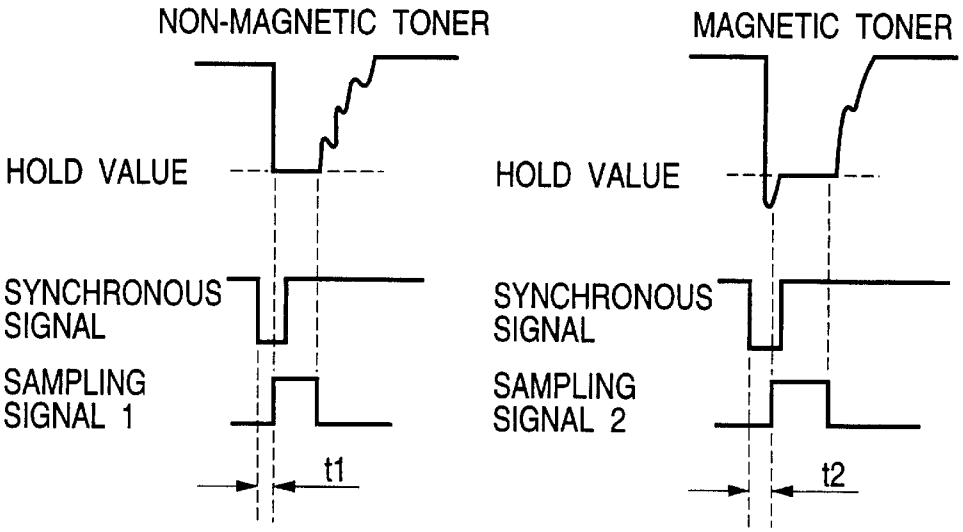
FIG. 6A
FIG. 6B

DEVELOPER AMOUNT DETECTING APPARATUS

BACKGROUND OF THE INVENTION

1. Field of the Invention

The present invention relates to a toner amount detecting apparatus for detecting a toner residual quantity (amount) and an integrated quantity of disposal toner in an image forming apparatus such as a copying machine, a printer and a facsimile etc. which utilize an electrophotographic processing system.

2. Related Background Art

FIG. 10 is a view schematically showing a construction of an image forming apparatus (which is a laser beam printer of a full-color mode) utilizing an electrophotographic processing system.

This image forming apparatus is constructed of an apparatus body (a printer engine) 19 incorporating a drum-like photographic photosensitive body (which is hereinafter referred to as a photosensitive drum) 1, a charging roller 2, an exposure apparatus (a scanner apparatus) 3, a developing apparatus 4, an intermediate transfer belt 5 serving as an intermediate transfer member, a secondary transfer roller 7, a conveying guide member 8, and a fixing unit 9.

The photosensitive drum 1 has an organic photoconductive layer (not shown) formed on a drum substrate (unillustrated) composed of aluminum. The photosensitive drum 1, to which a driving motor (not shown) is connected, rotates at a predetermined process speed by the driving motor.

The charging roller 2 is pressed by a predetermined pressing force against the surface of the photosensitive drum 1, and is so driven as to rotate with a rotational drive of the photosensitive drum 1. A power source (not shown) applies a predetermined charging bias to the charging roller 2, and the photosensitive drum 1 is thus subjected to a charging process with a predetermined polarity at a predetermined electric potential.

The exposure apparatus (the scanner apparatus) 3 includes an unillustrated laser diode, a polygon mirror, an image-forming lens system, and a reflecting mirror 3*a*. Upon an input of an image signal, the laser diode irradiates the polygon mirror with a beam of image light corresponding to the image signal. The surface of the photosensitive drum 1 rotating at a fixed speed is selectively exposed to the beam of image light reflected by the polygon mirror rotating at a high speed, thereby forming an electrostatic latent image on the surface of the photosensitive drum 1.

The developing apparatus 4 includes a yellow developing unit 4Y, a magenta developing unit 4M, a cyan developing unit 4C and a black developing unit 4Bk which serve to turn the electrostatic latent image into a visible image. The yellow, magenta, cyan and black developing units 4Y, 4M, 4C and 4Bk are provided with sleeves 4Ys, 4Ms, 4Cs and 4Bks, respectively.

The yellow, magenta, cyan and black developing units 4Y, 4M, 4C and 4Bk rotate with rotations of a developing rotary unit 4A when forming the image, and a predetermined sleeves among the sleeves 4Ys, 4Ms, 4Cs and 4Bks faces at a spacing as minute as approximately 300 $\mu$m to the photosensitive drum 1. A predetermined developing unit among the yellow, magenta, cyan and black developing units 4Y, 4M, 4C and 4Bk thereby halts in a developing position facing to the photosensitive drum 1, whereby the visible image is formed on the photosensitive drum 1.

The intermediate transfer belt 5 is supported by a drive roller 5*a*, a secondary transfer face-to-face roller 5*b* and a tension roller 5*c*, thus keeping a proper tension. The primary transfer roller 6 is so disposed as to come into contact with the photosensitive drum 1 through the intermediate transfer belt 5.

Next, an image forming operation by the image forming apparatus described above will be explained.

When forming the image, an unillustrated outside host computer outputs a print request signal to a printer engine controller. Next, after starting up a scanner motor (not shown), a start-of-print preparing operation is executed within the apparatus body 19, corresponding to the print signal. Upon a standby status, the printing operation is started.

A transfer material P such as a sheet of paper is fed out of a cassette paper feeding portion 10 by a cassette paper feed roller 11 or out of a multi-manual paper feeding portion 12 by a multi-manual paper feed roller 13, and is carried by a carrier roller 14. Then, the transfer sheet P, of which a skew feeding is corrected by a resist roller 16, thereafter temporarily stops. Hereupon, a timing is adjusted so that a front edge of the transfer sheet P is coincident with a front edge of the image, and the transfer sheet P is again carried.

On the other hand, the photosensitive drum 1 is rotationally driven by the driving unit (unillustrated) at the predetermined process speed, and receives the charging process with a predetermined polarity at a predetermined electric potential by the charging roller 2 to which a predetermined charging bias is applied. Then, the surface of the thus charged photosensitive drum 1 is image-exposed by the laser beams of the exposure apparatus 3, thereby forming an electrostatic latent image corresponding to a first color component image (e.g., a yellow component image) of a desired color image. Then, this electrostatic latent image is developed with the yellow toner defined as a first color by the yellow developing unit 4Y.

The first-color yellow toner image formed and borne on the photosensitive drum 1 is, in the process of passing through a transfer nip (a primary transfer portion) between the photosensitive drum 1 and the intermediate transfer belt 5, primarily transferred onto the intermediate transfer belt 5 by a pressure given at the primary transfer roller 6 and by a primary transfer bias applied to the primary transfer roller 6. Hereinafter, a second-color magenta toner image, a third-color cyan toner image and a fourth-color black toner image which are similarly formed and borne on the photosensitive drum 1 by the magenta developing unit 4M, the cyan developing unit 4C and the black developing unit 4Bk, are sequentially transferred in superposition onto the intermediate transfer belt 5, thus forming a synthetic color toner image corresponding to the desired color image.

Then, the transfer sheet P is fed at the timing described above to the transfer nip (the secondary transfer portion) between the intermediate transfer belt 5 and the secondary transfer roller 7. On this occasion, a secondary transfer bias is applied to the secondary transfer roller 7, and the synthetic color toner image is transferred onto the transfer sheet P from the intermediate transfer belt 5.

The transfer sheet P, onto which the synthetic color toner image has been transferred, is conveyed to a fixing unit 9 by the conveying guide member 8, and the color visible image is permanently fixed onto the transfer sheet P with heating and pressurization by a fixing roller 9*a* and by a pressurizing roller 9*b*. This transfer sheet P is discharged onto a discharge tray 18 via pairs of discharge rollers 17*a*, 17*b*, 17*c*.

The main body 19 of the image forming apparatus described above is provided with a toner residual quantity detecting apparatus for detecting a residual quantity of each color toner (the yellow toner, the magenta toner, the cyan toner and the black toner) used for the developing apparatus 4.

FIG. 11 is a view showing a construction of a light transmission type toner residual quantity detecting apparatus by way of one example thereof. This toner residual quantity detecting apparatus is provided on a side surface of the main body 19 of the apparatus in close proximity to a toner cartridge (toner CRG) 23 of the developing apparatus 4.

Referring to FIG. 11, a unit 21 is mounted with a light emitting element 20 and a light receiving element 22, and light guides 25, 26 serve to guide a quantity of light emitted from the light emitting element 20 to the light receiving element 22 via windows 24*a*, 24*b* of the toner CRG 23.

In this toner residual quantity detecting apparatus, a beam of light A emitted from the light emitting element 20 is incident upon the window 24*a* of the toner CRG 23 through within the light guide 25. Then, an agitator plate (see FIGS. 12A and 12B) 27 provided inside the toner CRG 23 scrapes off the toner T in the vicinity of the window 24*a*, whereby the incident light A travels through inside the toner CRG 23 and emerges from the window 24*b*. The light A having emerged therefrom is received by the light receiving element 22 via the light guide 26.

On this occasion, a detection timing of the light receiving signal is defined by a time width till the toner is agitated in the toner CRG 23 and consequently again covers over the vicinity of the window 24*b* enough to make the light A enable to penetrate, based on a point of time when the light A having passed through starts falling upon the light receiving element 22. This time signal pulse width differs depending on the toners left in the toner CRG. Accordingly, the toner residual quantity is judged based on this pulse width time signal.

Namely, as illustrated in FIG. 12A, if the toner residual quantity is large, the vicinity of the window 24*b* is covered with the toner T even when agitated by the agitator plate 27, and hence the time width of the pulse width signal decreases. Further, as shown in FIG. 12B, if the toner residual quantity is small, the vicinity of the window 24*b* is covered with a small quantity of the toner T, and therefore the time width of the pulse width signal increases.

FIG. 13 is a diagram showing a relationship between a light emission timing of the light emitting element 20, the light receiving signal of the light receiving element 22 which corresponds to a degree of the toner residual quantity, and a detection sampling timing of the light receiving signal.

Referring to FIG. 13, a level 1 of the light receiving signal indicates that the toner residual quantity is large, while a level 3 of the light receiving signal indicates that the toner residual quantity is small. Further, a level 2 of the light receiving signal indicates a toner residual quantity intermediate between the level 1 and the level 3. The light receiving signal is detected based on the pulse time width sampled during a light emitting period of the light emitting element 20.

An example of an actual detection thereof is given, wherein a detecting device such as a CPU etc. compares the pulse time width light receiving signal with a preset fixed threshold value, and a time width of a light receiving intensity signal over the threshold value is detected from an A/D port. Then, the CPU compares the detected signal time width with a threshold value, stored in a ROM incorporated therein, for judging whether or not the toner is present or not. Then, if the detected signal time width is over a fixed time, the CPU make a judgement of having reached a condition where no toners exist. As a result, an indication of an operator call is given, and the user is notified of this effect through a display etc. on an operation panel (not shown). A relationship between the detected pulse width of the light receiving time signal and the residual toner in the prior art, is as shown in, e.g., FIG. 14.

Incidentally, in the toner residual quantity detecting apparatus of the image of the image forming apparatus, the toners T are, as illustrated in FIG. 15, adhered somewhere along the light path extending from the holder 21 via the light guides 25, 26 to the toner CRG 23 as adhered specifically to the cap portion of the light emitting element 20 or the light receiving element 22 and especially light I/O edge surfaces of the light guides 25, 26, due to a toner leakage from the toner CRG 23 and a change with a passage of time which might be caused by scattering of the toner during an electrophotographic image forming process. Therefore, a light transmittance deceases in inverse proportion to the adhesion of the toner T.

Accordingly, if constructed to detect the light receiving signal with the threshold value fixed as described above, there is a possibility in which almost no toners are left in the toner CRG 23, and nevertheless it might occur that the light signal of the light receiving element 22 is not detected in the worst case. This phenomenon will hereinafter be explained referring to FIG. 16.

As shown in FIG. 16, normally, the light receiving signal exhibiting a light stain condition is still a detection signal under the fixed threshold value (a in FIG. 16 shows the light receiving signal when in the normal condition, and b indicates the light receiving signal when in a light stain condition), and hence the pulse width signal for judging whether or nor the toner is present, is to be generated.

If changed into the light receiving signal (indicated by c in FIG. 16) exhibiting a heavy stain condition due to the change with the passage of time etc, however, the detection signal is never under the fixed threshold value, and therefore the pulse width signal for judging whether or not the toner is present, is not generated.

It might be also considered such a contrivance that a value of the light quantity of the light emitting element or a sensitivity of the light receiving element is increased by previously estimating the stain due to the above-described change made as the time elapses with a conversion from a life-span of the apparatus body. It is, however, difficult to estimate under the worst conditions in terms of a quantity of the toner scattered and leaked. Further, it is impossible to actualize the above contrivance at a stage of mass production in the case of taking into consideration a fitting precision of the light emitting element, the light receiving element and the light guides which constitute the light transmission path, with respect to the optical axis.

SUMMARY OF THE INVENTION

It is a primary object of the present invention to provide a developer amount detecting apparatus capable of detecting an amount of developer with a stability.

It is another object of the present invention to provide a developer amount detecting apparatus capable of stably detecting an amount of developer at a high accuracy even when toners might be scattered on a light transmission path and elements thereof might be stained with the toners.

Other objects and features of the present invention will become more apparent in the following discussion in conjunction with the accompanying drawings.

BRIEF DESCRIPTION OF THE DRAWINGS

FIG. 5 is a block diagram showing the toner amount detecting apparatus of the image forming apparatus in an embodiment 3 of the present invention;

FIG. 6A is a diagram showing a relationship in timing between the light receiving signal and the sampling signal in the embodiment 3 of the present invention when using a nonmagnetic toner; FIG. 6B is a diagram showing a relationship in timing between the light receiving signal and the sampling signal in the embodiment 3 of the present invention when using a magnetic toner;

DESCRIPTION OF THE PREFERRED EMBODIMENTS

Embodiments of the present invention will hereinafter be described with reference to the accompanying drawings.

Embodiment 1

Figure 1:
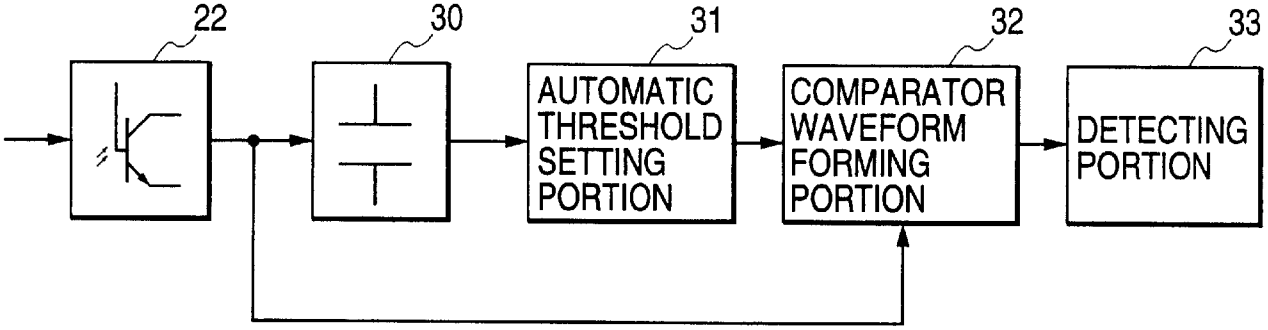
FIG. 1 is a block diagram showing a toner amount detecting apparatus of an image forming apparatus in an embodiment 1 of the present invention.

FIG. 1 is a block diagram showing a construction of a toner amount detecting apparatus (developer amount detecting apparatus) in an image forming apparatus (exemplified as a full-color mode laser printer in FIG. 1) in an embodiment 1. The embodiment 1 embraces an example of being applied to a detection of a toner residual amount quantity, wherein each amount of the toners defined as developers (which are a yellow toner, a magenta toner, a cyan toner and a black toner), is independently detected.

Figure 10:
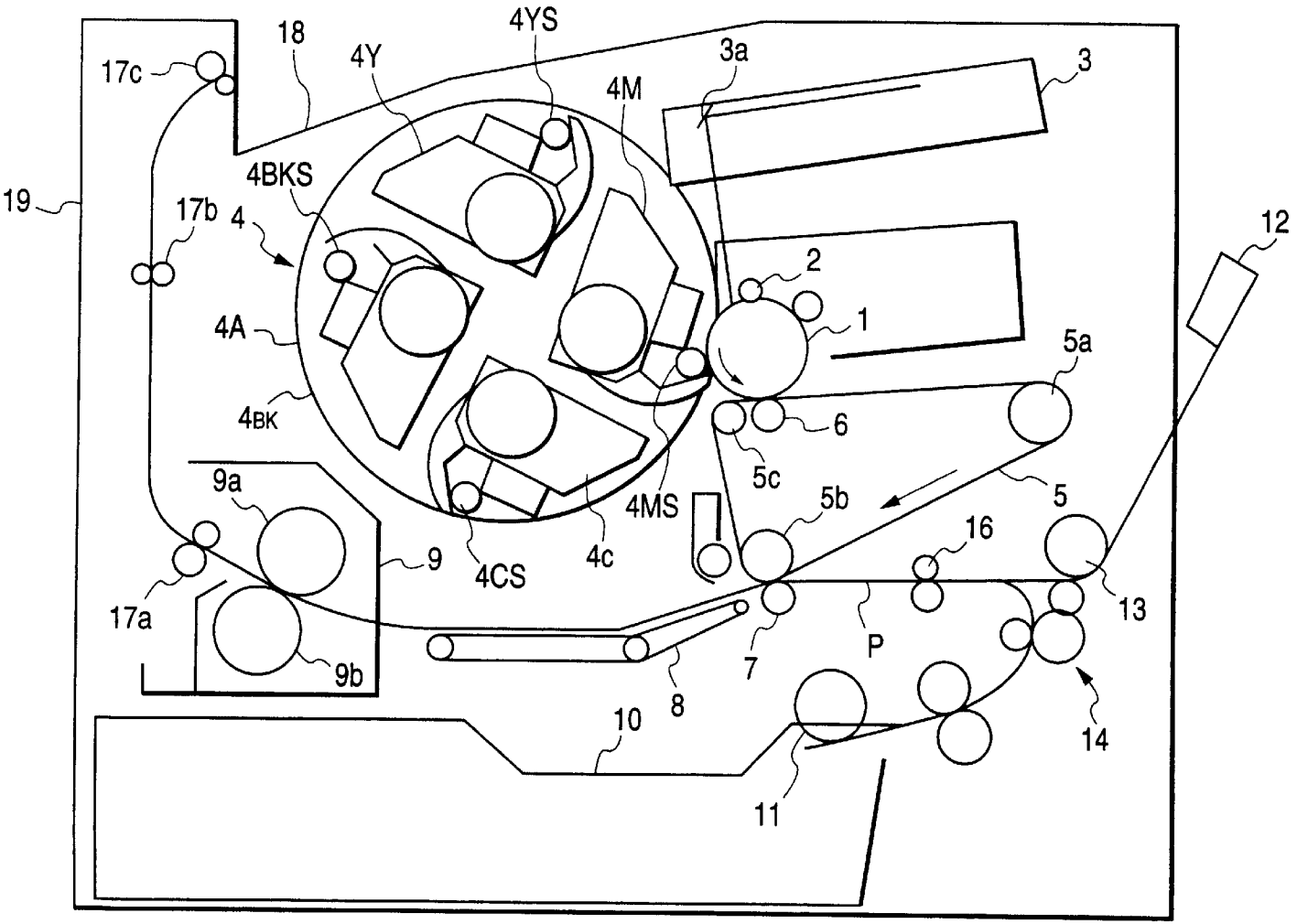
FIG. 10 is a schematic block diagram showing the image forming apparatus.

The image forming apparatus in the embodiment 1 is constructed the same as the image forming apparatus shown in FIG. 10, of which the explanation is omitted in the embodiment 1.

Figure 11:
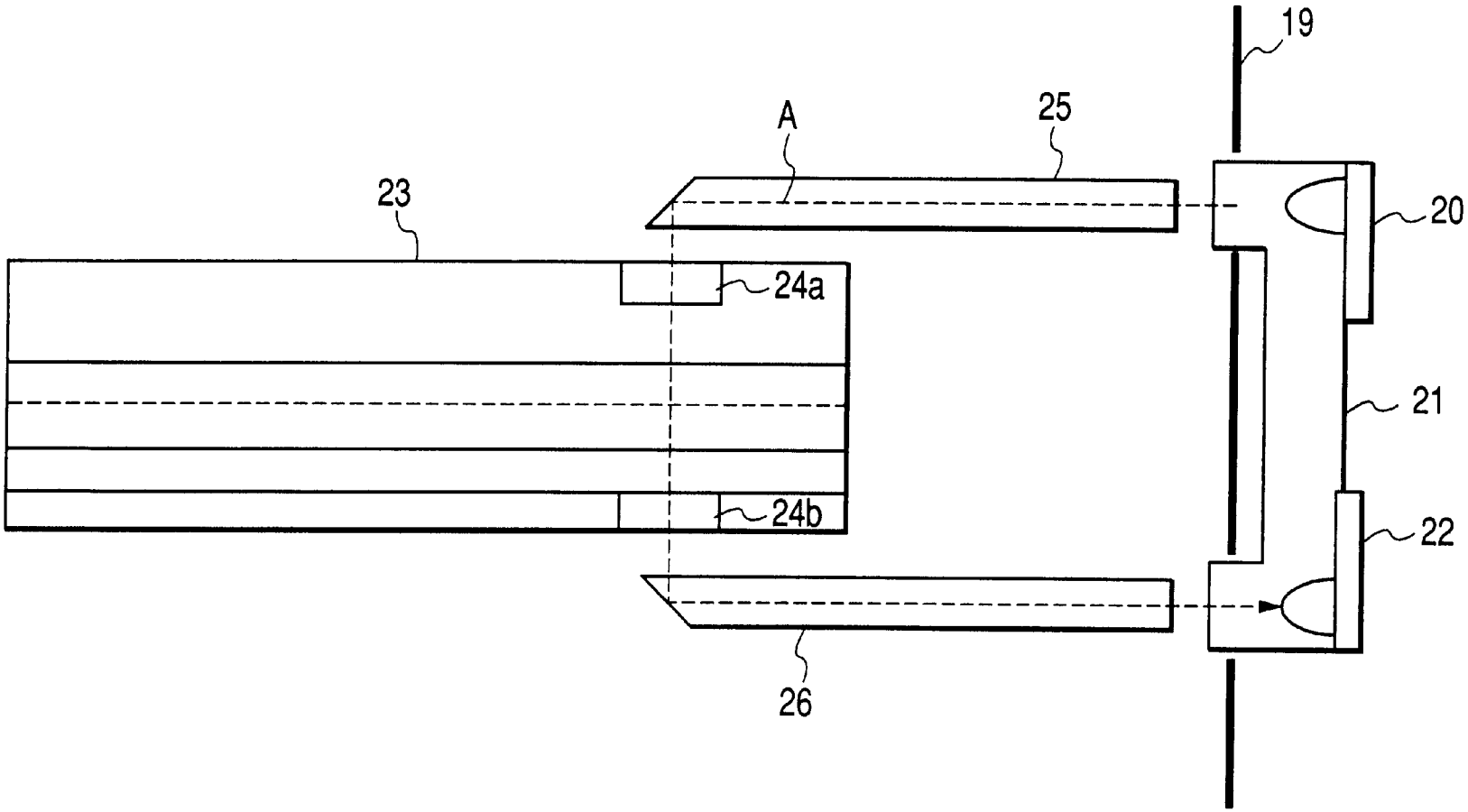
FIG. 11 is a block diagram showing the toner amount detecting apparatus of the image forming apparatus.
Figure 12B:
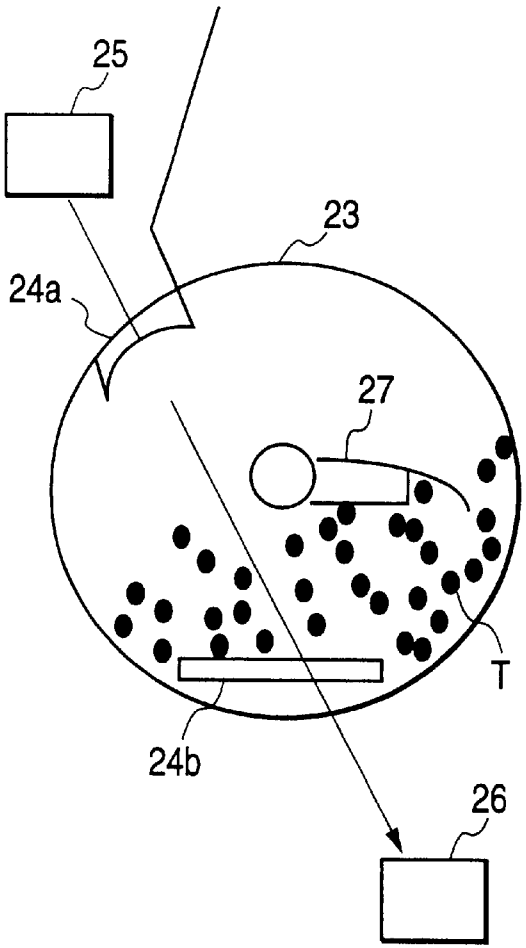
FIG. 12B is an explanatory diagram showing a light transmission in a toner empty state of the toner amount detecting apparatus.
Figure 12A:
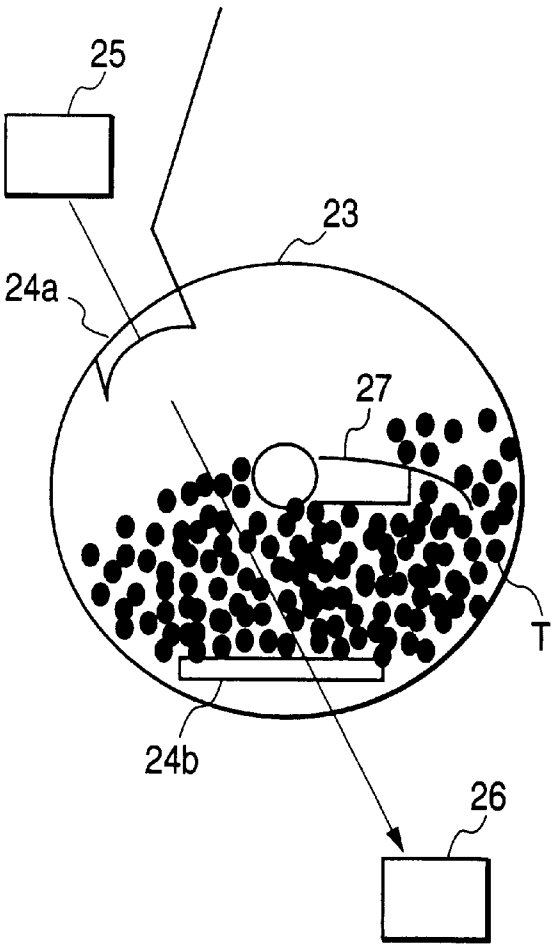
FIG. 12A is an explanatory diagram showing a light transmission in a full-of-toner state of the toner amount detecting apparatus.
Figure 13:
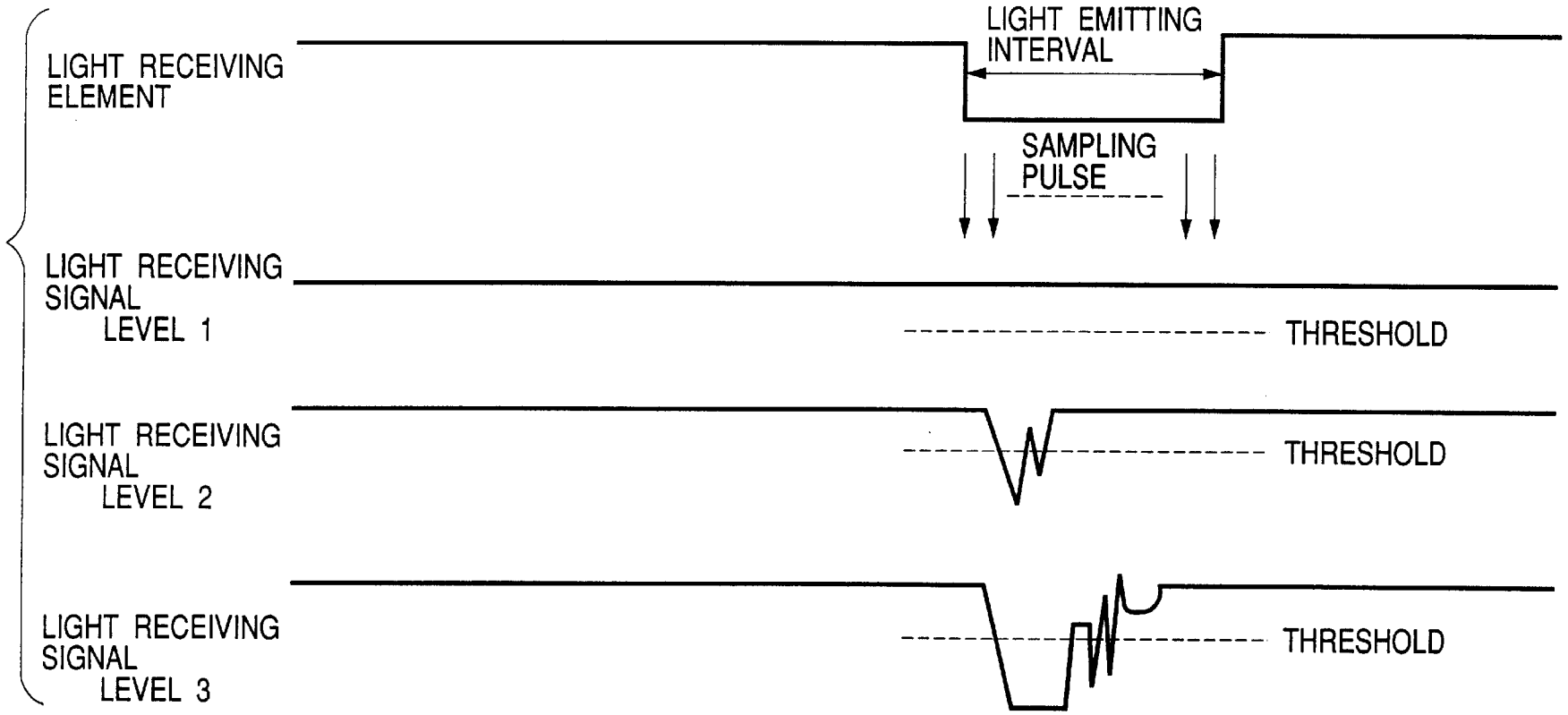
FIG. 13 is a diagram showing a relationship in detection sampling timing between the light receiving signal and a light emission timing of the toner amount detecting apparatus.
Figure 14:
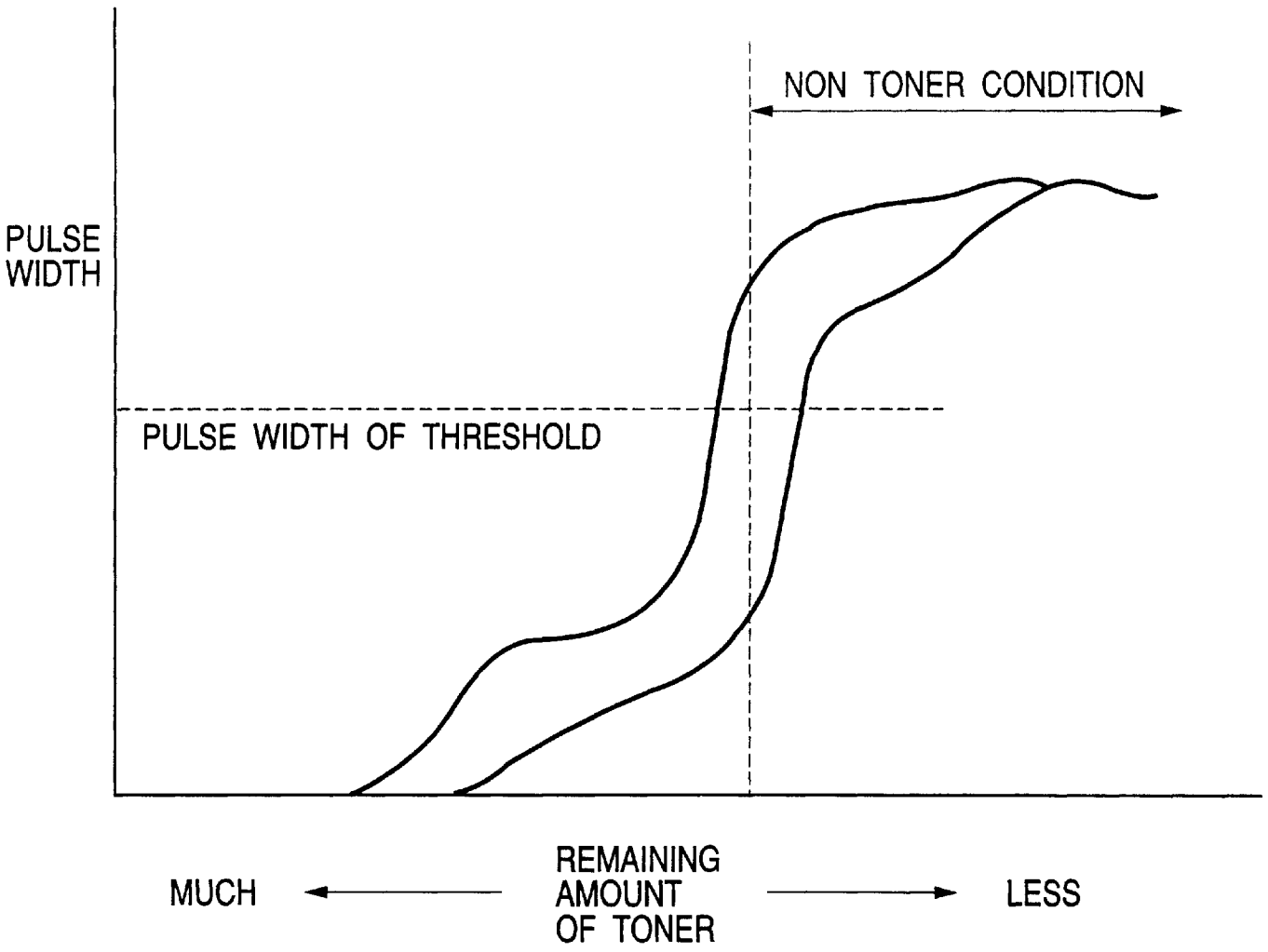
FIG. 14 is a diagram showing a relationship between a residual toner in the toner amount detecting apparatus and a light receiving signal pulse width to be detected.
Figure 15:
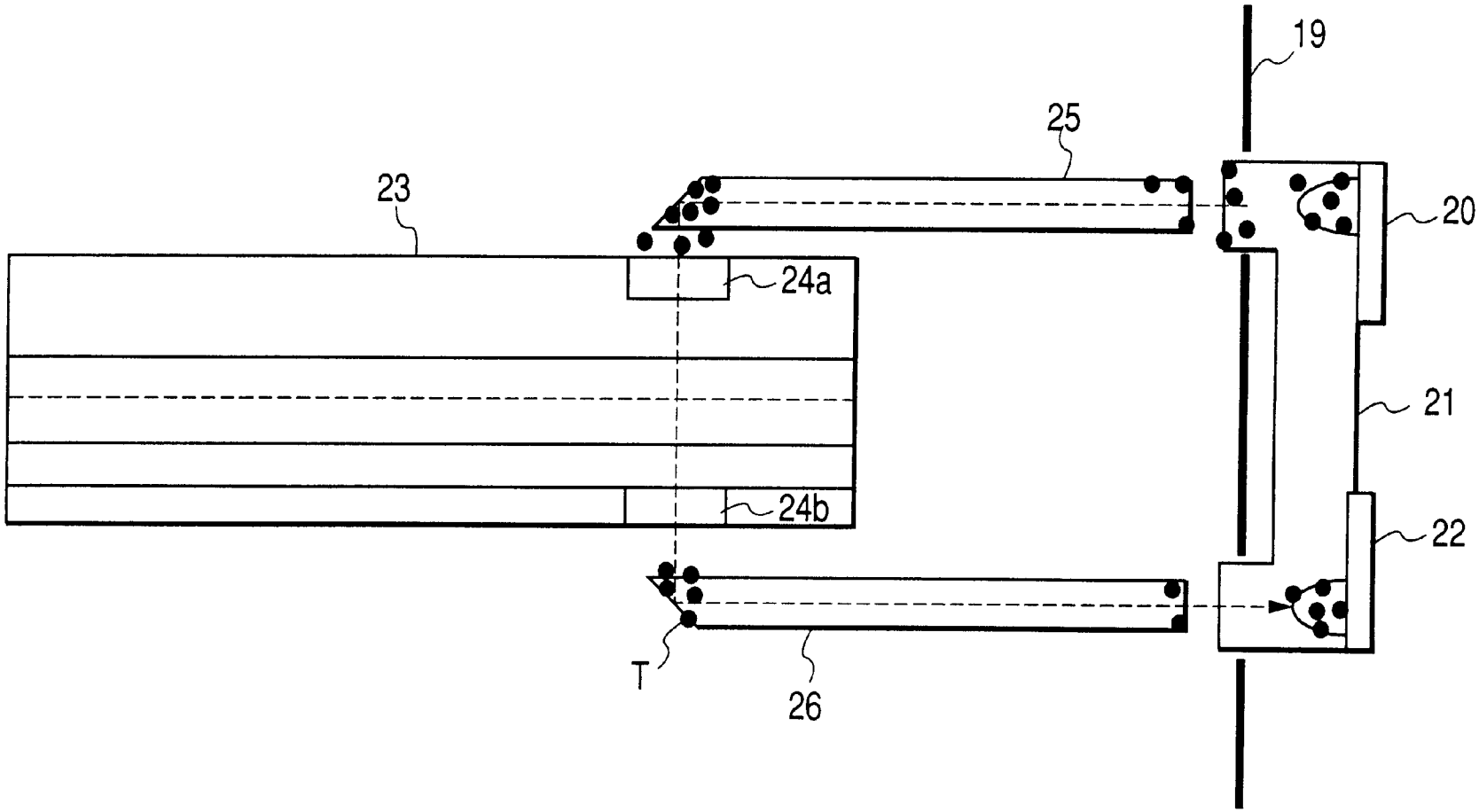
FIG. 15 is a diagram showing a state of how the toners are adhered to some portions on a light path of the toner amount detecting apparatus.
Figure 16:
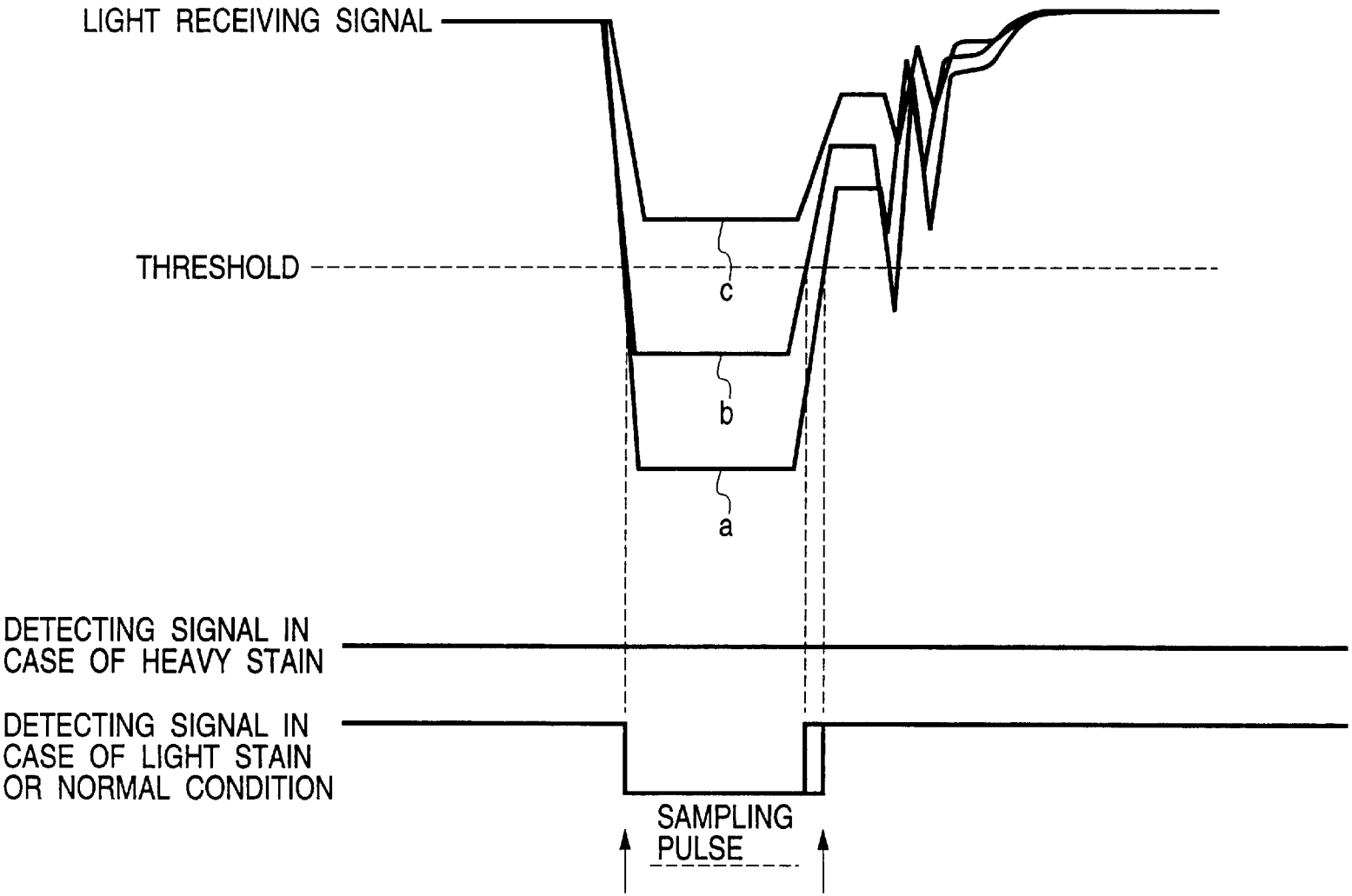
FIG. 16 is a diagram showing a relationship between the light receiving signal and the signal having the detected pulse width, corresponding to an amount of adhesion of the toners adhered on the light path of the toner amount detecting apparatus.

A light transmission type of toner residual amount detecting apparatus in the embodiment 1, as shown in FIG. 1, includes a bottom holding portion 30 for holding a level value in the vicinity of a maximum bottom value (a maximum quantity-of-light value) defined as a peak of a light receiving signal (a light detection signal) of the light incident via a light detection light (extending from a light emitting element 20 down to a light receiving element 22 through a light guide 25, windows 24*a*, 24*b* and a light guide 26 shown in FIG. 11) which is detected by the light receiving element 22 as shown in FIG. 1, and an automatic threshold setting portion 31 for setting a threshold value (a standard value) to such a level as to exhibit a relationship of a predetermined rate corresponding to the level value held by the bottom holding portion 30. The toner residual amount detecting apparatus further includes a comparator waveform shaping portion 32 for comparing a light receiving signal level with a level of the threshold value and outputting a signal of a compared result, and a detecting portion 33 for detecting an amount of toner on the basis of a signal inputted from the comparator waveform shaping portion 32. Note that a construction and an operation till the light emitted out of the light emitting element 20 falls upon the light receiving element 22, are the same as those in the prior art illustrated in FIG. 11, of which the explanation is omitted in the embodiment 1.

Figure 2:
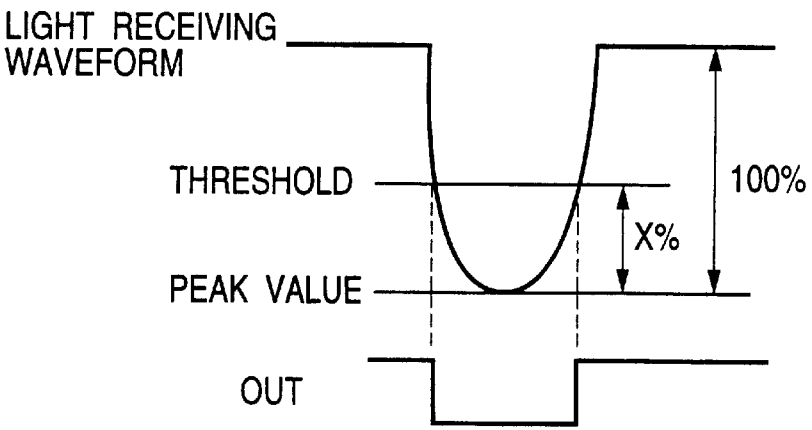
FIG. 2 is a diagram showing an output signal and a threshold value of a light receiving signal in the embodiment 1 of the present invention.

The automatic threshold setting portion 31, as shown in FIG. 2, sets the threshold value to arbitrary x% (x<100%, where x is, e.g., 70%), in which the 10 maximum bottom value (the maximum quantity-of-light value) of the light receiving signal (the photodetection signal) detected by the light receiving element 22 which is held by the bottom holding portion 30, is assumed to be 100%. Then, the comparator waveform shaping portion 32 shapes a waveform of the light receiving signal and outputs it as a detection signal. The bottom holding portion 30 automatically follows up the maximum bottom value (the maximum quantity-of-light value) of the photo detection signal detected by the light receiving element 22 in accordance with a light receiving quantity of the light incident upon the light receiving element 22. The automatic threshold setting portion 31 sets an arbitrary threshold value with respect to this maximum bottom value (the maximum quantity-of-light value).

Then, the threshold value, stored in a ROM within the detecting portion 33 such as a CPU, for judging whether the toners exist or not, is compared with a time width of the detection signal detected. Subsequently, when a pulse time width of the detection signal detected is over a fixed time, it is judged that no toners or an extremely small amount of the toners are left. An indication of an operator call is given, and the user is notified of no toners being left through a display on an operation panel (not shown).

Thus, in accordance with the embodiment 1, the bottom holding portion 30 holds the maximum bottom value (the maximum quantity-of-light value) of the light receiving quantity (the light receiving signal) of the light incident upon the light receiving element 22. The threshold value is set to arbitrary x% (x<100%), wherein this hold value (the maximum quantity-of-light value) is assumed to be 100%. A relationship between the light receiving signal and the threshold value can be thereby kept constant at all times, and hence, even if a light receiving quantity decreases because of the toners being adhered to the light detection path (extending from the light emitting element 20 down to the light receiving element 22 through the light guide 25, the windows 24*a*, 24*b* and the light guide 26), it is feasible to generate the pulse width signal for judging whether the toners exist or not at a high accuracy.

Accordingly, during a developing process by a developing apparatus, an alarm indication showing that none or a trace of the toners are left, is given to the user by stably detecting the amount of the toners at a high accuracy, whereby a poor image can be prevented from being formed.

Further, the embodiment 1 has the construction of holding the bottom value of the light receiving signal, however, a peak value, opposite to the bottom value, of the light receiving signal may also be held depending on a circuit configuration.

Note that the automatic threshold setting portion 31 sets the threshold value each time and, in addition, may set the threshold value at an interval of a predetermined number of image formations. Furthermore, the threshold value may be set only when the power source of the image forming apparatus is switched ON.

Embodiment 2

Figure 3:
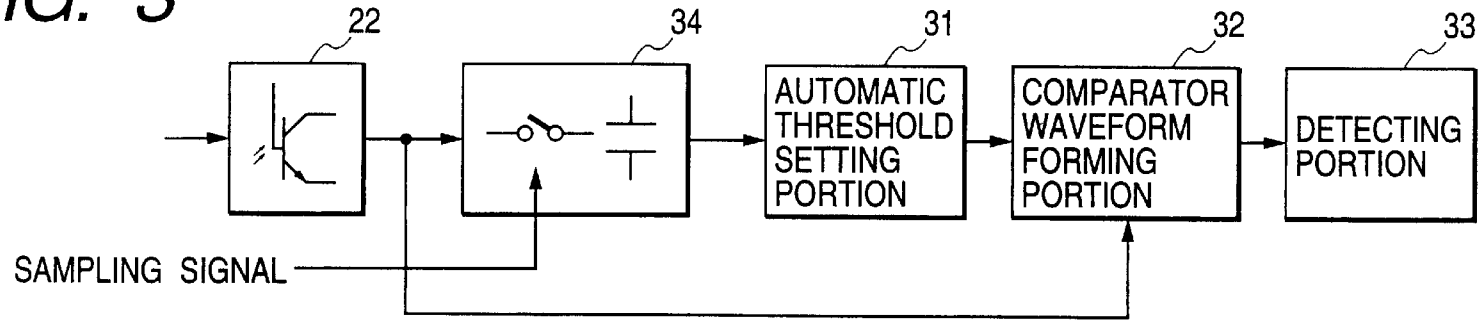
FIG. 3 is a block diagram showing the toner amount detecting apparatus of the image forming apparatus in an embodiment 2 of the present invention.

FIG. 3 is a block diagram showing the toner amount detecting apparatus (the developer amount detecting apparatus) of the image forming apparatus in an embodiment 2. It is to be noted that the same components as those of the toner residual amount detecting apparatus shown in FIG. 1 are marked with the like reference numerals and labels, and the repetitive explanation is omitted.

The embodiment 2 has such a construction that a bottom sample holding portion 34 is provided as a substitute for the bottom holding portion 30 exemplified in the embodiment 1, and other configurations are the same as those in the embodiment 1.

Figure 4:
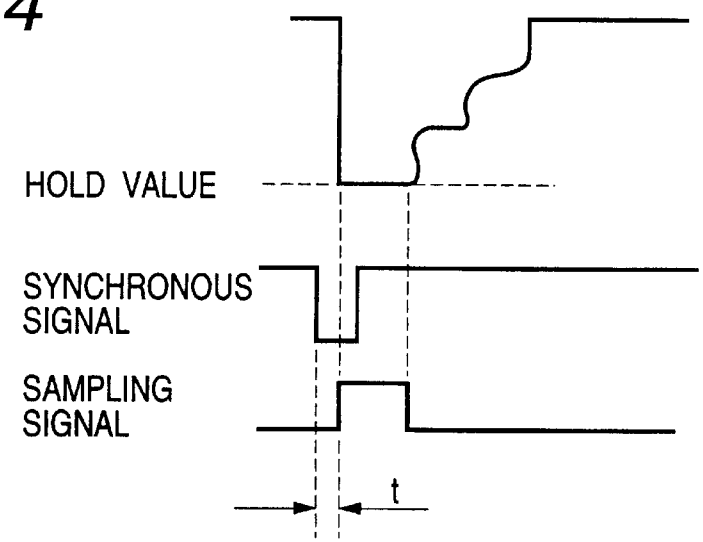
FIG. 4 is a diagram showing a relationship in timing between the light receiving signal and a sampling signal in the embodiment 2 of the present invention.

The bottom sample holding portion 34, as shown in FIG. 4, samples and holds a level in the vicinity of the maximum bottom value (the maximum quantity-of-light value) of the light receiving signal of the light receiving element 22 in response to a sampling signal transmitted from a sampling signal generating portion (unillustrated) provided outside. The sampling signal is generated at a timing (a time t since a synchronous signal in FIG. 4 is turned ON) at which to stabilize the level of the light receiving signal, synchronizing with light emission control of the above-described light emitting element 20 (see FIG. 11) at a timing of an image forming sequence of the image forming apparatus. Other operations are the same as those in the embodiment 1.

As discussed above, in the embodiment 2, the level in the vicinity of the maximum bottom value (the maximum quantity-of-light value) of the light receiving signal of the light receiving element 22, is sampled and held in response to the sampling signal, whereby a misdetection hold in a transient state of the light receiving signal can be prevented in addition to the effects obtained in the embodiment 1.

Embodiment 3

FIG. 5 is a block diagram showing the toner amount detecting apparatus (the developer amount detecting apparatus) of the image forming apparatus in an embodiment 3. Note that the same components as those of the toner amount detecting apparatus in the embodiment 1 shown in FIG. 1 are marked with the like reference numerals at labels, and the repetitive explanation is omitted.

The embodiment 3 has a construction that a selector 35 is connected to the bottom sample holding portion 34, and other configurations are the same as those in the embodiments 1 and 2.

The selector 35, based on a toner discrimination signal inputted from a toner discriminating portion (not shown), selects a sampling signal 1 or 2 inputted from a sampling signal generating portion (unillustrated) provided outside, and outputs the sampling signal to the bottom sample holding portion 34.

The bottom sample holding portion 34, as shown in FIGS. 6A and 6B (FIG. 6A shows nonmagnetic toners for development of a color image, and FIG. 6B shows magnetic toners for development of a black-and-white image), samples and holds a level in the vicinity of the maximum bottom value (the maximum quantity-of-light value) of the light receiving signal of the light receiving element 22 in response to the sampling signals 1, 2 transmitted from the sampling signal generating portion (not shown) provided outside. The sampling signals 1, 2 are generated at a timing (a time t1 and a time t2 since the synchronous signal in the Figures is turned ON) at which to stabilize the level of the light receiving signal, synchronizing with the light emission control of the above-described light emitting element 20 (see FIG. 11) at the timing of the image forming sequence of the image forming apparatus. Other operations are the same as those in the embodiments 1 and 2. Note that generally speaking, if a kind of the toner is different, an agitating velocity of the toners becomes different, and therefore the waveform of the light receiving signal differs.

Incidentally, when forming an image by using plural kinds of the toners as in the case of a color image, it must be a general aspect that a detection characteristic differs depending upon a behavior of the toners. Accordingly, there might be considered following two methods of judging whether or not the toner residual quantity is detected as in the case of the embodiment 3.

This is because there are two parameter to be set, i.e., a light receiving quantity comparison threshold value RTh set at a predetermined ratio to the peak value of the light receiving quantity, and a judgement threshold value JTh with respect to the detection pulse time width. These two cases are explained referring to FIGS. 7A, 7B, 8A and 8B.

Figure 7A:
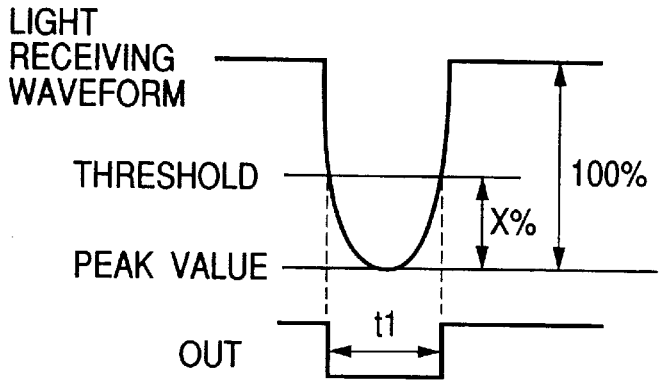
FIG. 7A is a diagram showing the output signal and the threshold value of the light receiving signal in the embodiment 3 of the present invention when using the nonmagnetic toner.
Figure 7B:
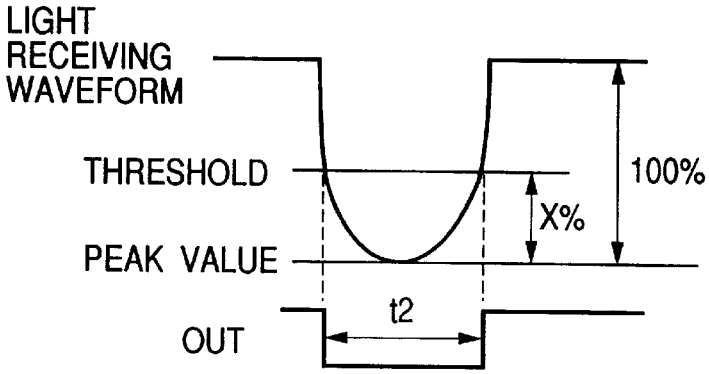
FIG. 7B is a diagram showing the output signal and the threshold value of the light receiving signal in the embodiment 3 of the present invention when using the magnetic toner.

The first case is that, as shown in FIGS. 7A and 7B, the light receiving quantity comparison threshold value RTh is set to the same value in accordance with the kinds of toners (FIG. 7A shows the nonmagnetic toner for development of the color image, and FIG. 7B shows the magnetic toner for development of the black-and-white image), and the judgement threshold value JTh is set to a different value. Referring again to FIGS. 7A and 7B, the light receiving quantity is set to the same value of arbitrary x% (x<100%) wherein the maximum bottom value (the maximum quantity-of-light value) of the light receiving signal (the light detection signal) detected by the light receiving element 22 which is held by the bottom sample holding portion 34, is assumed to be 100%, in which case the pulse width times t1 and t2 of the light receiving signal take different values (t1≠t2) even when the amounts of the toners are the same if the kinds of toners (the nonmagnetic toner, and the magnetic toner) are different.

This is related to the fact that if the light receiving quantity comparison threshold value RTh is set to the same value, a toner agitating velocity of the magnetic toner is generally different from that of the nonmagnetic toner, and hence the pulse width times are different even when the toner residual quantities have the same weight.

Then, in the first case, the judgement threshold value JTh is set to the different value, whereby the judgement is made absorbing an influence due to a difference in the toner agitating velocity.

Figure 8A:
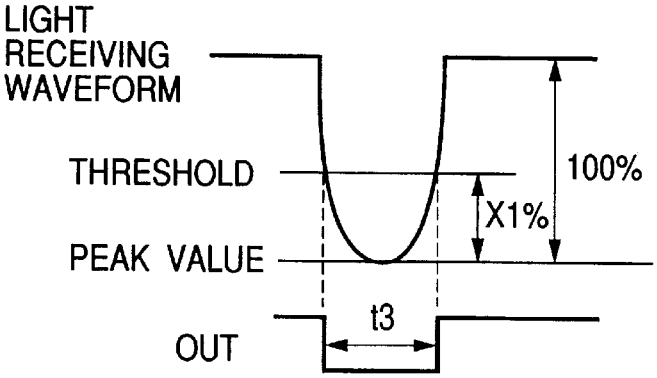
FIG. 8A is a diagram showing the output signal and the threshold value of the light receiving signal in the embodiment 3 of the present invention when using the nonmagnetic toner.
Figure 8B:
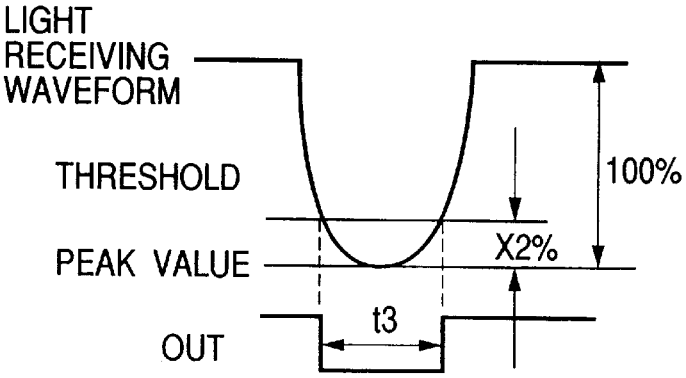
FIG. 8B is a diagram showing the output signal and the threshold value of the light receiving signal in the embodiment 3 of the present invention when using the magnetic toner.

On the other hand, the second case is that, as shown in FIGS. 8A and 8B, the light receiving quantity comparison threshold value RTh is set to a different value in accordance with the kinds of the toners (FIG. 8A shows the nonmagnetic toner for development of the color image, and FIG. 8B shows the magnetic toner for development of the black-and-white image), and the judgement threshold value JTh is set to the same value. Referring to FIGS. 8A and 8B, the light receiving quantity threshold value is set to x1%, x2% (x1≠x2<100%) of arbitrary different values depending on the kinds of the toners (the nonmagnetic toner, and the magnetic toner), wherein the maximum bottom value (the maximum quantity-of-light value) of the light receiving signal (the light detection signal) detected by the light receiving element 22 which is held by the bottom sample holding portion 34, is assumed to be 100%. Accordingly, a pulse width time t3 of the light receiving signal with respect to a predetermined amount of toner is set to the same value (t3) irrespective of the kinds of the toners (the nonmagnetic toner, and the magnetic toner).

As described above, in the second case, the light receiving quantity comparison threshold value is set to the different value, thereby making it feasible to absorb the influence due to the difference in the toner agitating velocity. The pulse width time can be thereby set the same when the toner residual quantities have the same weight. Hence, it is possible in such a case to judge by setting the judgement threshold value JTh to the same value both for the magnetic toner and for the nonmagnetic toner.

Embodiment 4

Figure 9:
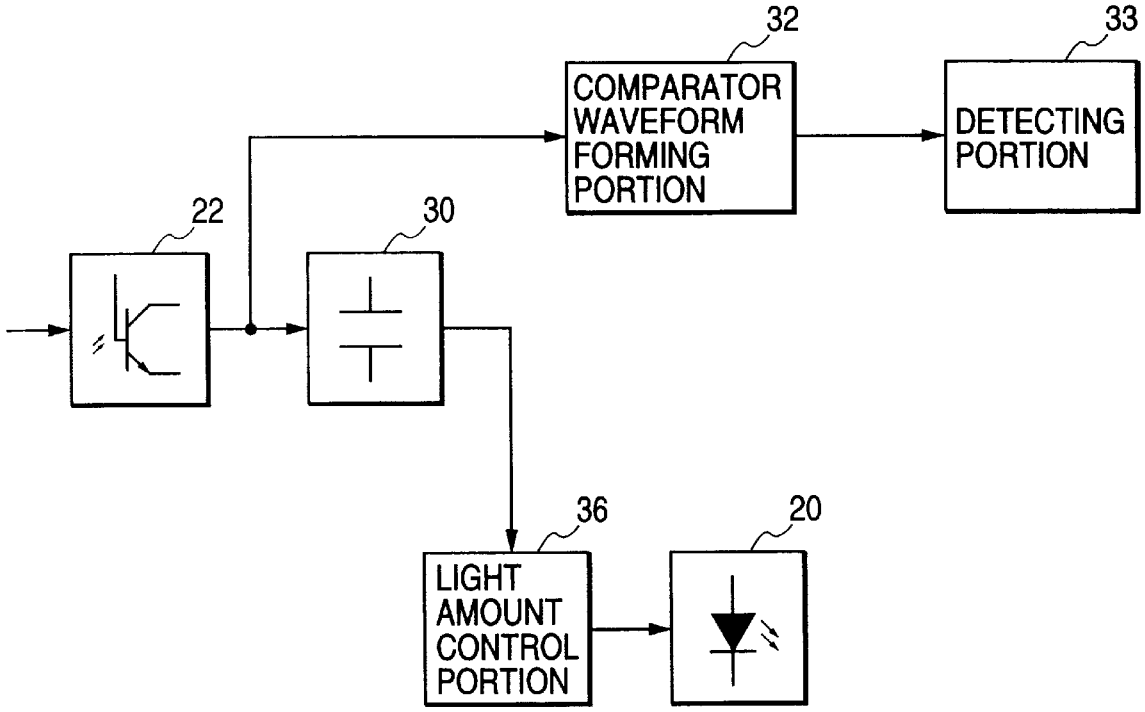
FIG. 9 is a block diagram showing the toner amount detecting apparatus of the image forming apparatus in an embodiment 4 of the present invention.

FIG. 9 is a block diagram showing the toner amount detecting apparatus (the developer amount detecting apparatus) of the image forming apparatus in an embodiment 4. Note that the same components as those of the toner amount detecting apparatus in the embodiment 1 shown in FIG. 1 are marked with the like reference numerals and legends, and the repetitive explanation is omitted.

The embodiment 4 has such a construction that a light amount control portion 36 is provided between the bottom holding portion 30 and the light emitting element 20. The light amount control portion 36 performs feedback-control between the light emitting element 20 and the light receiving element 22 on the basis of a deviation between the hold signal of the bottom holding portion 30 and a target value. The light amount control portion 36 control a light emitting quantity of the light emitting element 20 so that the bottom hold signal of the bottom holding portion 30 becomes the target value.

As explained above, in the embodiment 4, the light amount control portion 36 makes variable the light emission quantity of the light emitting element so that the bottom hold signal of the bottom holding portion 30 comes to the target value, whereby the same effects as those in the embodiment 1 can be also obtained.

Further, the embodiment 4 has the construction that the light emission quantity of the light emitting element 20 is controlled based on the bottom hold signal. The present invention is not, however, limited to this construction, and the bottom sample hold signal explained in the embodiments 2 and 3 may also be used.

Moreover, the description of each of the embodiments discussed above has concentrated upon the detection of the residual toner inside the toner CRG. However, an integrated quantity of disposal toner left after having formed the image can be detected similarly by utilizing a toner integrated quantity light transmission.

Incidentally, when detecting an integrated quantity of the disposal toners as in the case of detecting the toner residual quantity, a quantity of light traveling through a disposal toner container decreases as the disposal toners are integrated reversely when detecting the toner residual quantity, the pulse time width of the comparator waveform shaping output is narrowed.

As discussed above, in accordance with the embodiment 4, the threshold value of the light receiving signal of the light receiving element is set to the level at which to show the predetermined rate to the level value in the vicinity where the light receiving signal changes at the maximum, whereby the relationship between the light receiving signal and the threshold value thereof becomes always constant. It is therefore feasible to obtain the invariably stable toner detection signal even if the quantity of light might decrease due to the toners being leaked or scattered and consequently adhered somewhere of the light emitting element, the light receiving element and the light paths thereof.

Further, the light emitting quantity of the light emitting element is feedback-controlled corresponding to the difference between the level value and the target value so that the level value holding the level in the vicinity where the light receiving signal of the light receiving element changes at the maximum, reaches the predetermined target value, whereby the level of the light receiving signal always becomes constant. This makes it possible to obtain the invariably stable toner detection signal even if the quantity of light might decrease due to the toners being leaked or scattered and consequently adhered somewhere of the light emitting element, the light receiving element and the light paths thereof.

Accordingly, the toner residual quantity or the disposal toner integrated quantity can be invariably stably detected at the high accuracy by applying the toner amount detecting apparatus in the embodiment 4 to the detections of the toner residual quantity and of the disposal toner integrated quantity.

What is claimed is:

1. A developer amount detecting apparatus, comprising:

light emitting means for emitting a light;

light receiving means for receiving the light passing through a developer container;

threshold value changing means for changing a threshold value on the basis of an intensity of the light received by said light receiving means; and detecting means for detecting an amount of a developer within the developer container on the basis of the threshold value and the intensity of the light received by said light receiving means.

2. A developer amount detecting apparatus according to claim 1, wherein the threshold value changing means automatically changes the threshold value to a value in the vicinity of a maximum intensity of the light received by said light receiving means.

3. A developer amount detecting apparatus according to claim 1, wherein the threshold value changing means automatically changes the threshold value to a peak value of the intensity of the light received by said light receiving means.

4. A developer amount detecting apparatus according to claim 1, wherein said detecting means detects an amount of the developer within the developer container in accordance with a pulse time width generated by comparing the intensity of the light received by said light receiving means with the threshold value.

5. A developer amount detecting apparatus according to claim 1, wherein the apparatus further comprises a plurality of developers including a yellow toner, a magenta toner, a cyan toner and a black toner, and said developer amount detecting apparatus individually detects an amount of the toner of each color.

6. A developer amount detecting apparatus according to claim 1, wherein said threshold value changing means changing the threshold value on the basis of the intensity of the light received by said light receiving means within a predetermined time during a period for which said light receiving means receives the light.

7. A developer amount detecting apparatus according to claim 6, wherein said threshold value changing means changes the threshold value on the basis of a peak value of the intensity of the light received by said light receiving means within a predetermined time during a period for which said light receiving means receives the light.

8. A developer amount detecting apparatus according to claim 6, wherein the threshold value changing means automatically changes the threshold value on the basis of the intensity of the light received by said light receiving means, based on a timing in an image forming sequence of an image forming apparatus, within the timing.

9. A developer amount detecting apparatus according to claim 4, wherein said detecting means makes a determination that a residual amount of the developer within the developer container is small on the basis of a result of comparing the generated pulse time width with a predetermined pulse time width.

10. A developer amount detecting apparatus according to claim 9, wherein the predetermined time width differs respectively in the case of detecting a developer for forming a black image, and in the case of detecting the developer for forming a color image.

11. A developer amount detecting apparatus according to claim 2, wherein the threshold value differs respectively in the case of detecting a developer for forming a black image, and in the case of detecting the developer for forming a color image.

12. A developer amount detecting apparatus, comprising:

light emitting means for emitting a light;

light receiving means for receiving the light passing through a developer container;

changing means for changing an intensity of the light emitted by said light emitting means on the basis of an intensity of the light received by said light receiving means; and detecting means for detecting an amount of the developer within the developer container on the basis of the intensity of the light received by said light receiving means.

13. A developer amount detecting apparatus according to claim 12, wherein said changing means changes the intensity of the light emitted by said light emitting means so that a peak value of the intensity of the light received by said light receiving means becomes a predetermined value.

* * * * *

UNITED STATES PATENT AND TRADEMARK OFFICE

CERTIFICATE OF CORRECTION

PATENT NO. : 6,122,459
DATED : September 19, 2000
INVENTOR(S) : Yoshimi Ogasawara It is certified that error appears in the above-identified patent and that said Letters Patent is hereby corrected as shown below:

Column 4:
Line 4, "toners exist." should read -- toner is present. --.

Column 11:
Line 19, "changing" should read -- changes --;
Line 34, "within" should read -- within a predetermined time after --.

Signed and Sealed this

Ninth Day of October, 2001

*Attest:*

Nicholas P. Godici

*Attesting Officer*

NICHOLAS P. GODICI
*Acting Director of the United States Patent and Trademark Office*